US005394656A

United States Patent [19]

Parker

[11] Patent Number: 5,394,656

[45] Date of Patent: Mar. 7, 1995

[54] PLASTICS RAINWATER GUTTERING SYSTEMS

[75] Inventor: Robert W. Parker, The Green Bearsted, United Kingdom

[73] Assignee: Caradon Terrain Limited, United Kingdom

[21] Appl. No.: 62,435

[22] Filed: May 13, 1993

[51] Int. Cl.[6] ..... E04D 13/04

[52] U.S. Cl. ..... 52/11; 248/48.1; 405/119

[58] Field of Search ..... 405/119, 120, 121, 122, 405/123; 52/11, 16; 248/48.1, 48.2

[56] References Cited

U.S. PATENT DOCUMENTS 3,388,555 6/1968 Foster ..... 405/119

4,878,782 11/1989 Beattie et al. ..... 405/119

*Primary Examiner*—David H. Corbin

*Attorney, Agent, or Firm*—Davis, Bujold & Streck

[57] ABSTRACT

The invention provides a rainwater guttering system comprising plastic trough shaped gutter lengths (1) in which one side wall (2) of each length is extended upwardly and reversed back on itself to form an inverted U-shaped clip (3) which fits over the upper edge (4) of a fascia board (5) which provides a continuous support. Adjacent gutter lengths are directly fixed together and supported at selected spaced points, the arrangement being such that any changes in length dimensions of the system due to temperature changes are accommodated by local buckling of the gutter lengths. Preferably, the system includes a fascia board (5) especially formed to present a continuous free upper edge.

9 Claims, 3 Drawing Sheets

22
23
26

22
21
24
23
1
20

22
21
23
1

PLASTICS RAINWATER GUTTERING SYSTEMS

This invention relates to plastics rainwater guttering systems and, in particular, to the manner in which the guttering, which in normally trough-shaped and supplied in lengths, is supported.

The traditional manner of support is via gutter brackets which are secured at regularly spaced positions along a fascia board beneath the eaves of a building. Being of a plastics, normally PVC, it is necessary to cater for a small co-efficient of expansion of the material due to changes in ambient temperature throughout the seasons. Therefore, it is normal practice to secure the ends of the gutter lengths together via expansion joints. Whilst support brackets are effective in use, it is time consuming and troublesome to mount them accurately along the fascia board so that the gutter lengths are in alignment and set at an acceptable angle of inclination towards an assocated down pipe. As a result, support brackets have been developed which can be adjusted in height relative to their fixing point on the fascia board in order to set the alignment and inclination of the gutter lengths. However, this adds complexity to the design of the gutter brackets and adds to their manufacturing cost.

The principal object of the present invention is to provide a rainwater guttering system which avoids the need to mount individual support brackets on a fascia board to facilitate setting the alignment and inclination of the gutter lengths.

A further object of the invention is to provide a system in which expansion joints can be dispensed with between gutter lengths.

According to this invention a plastics rainwater guttering system comprises gutter lengths of generally trough shaped cross-section in which one of the side walls of each gutter length is extended upwardly and reversed back on itself to form an "inverted U-shaped" clip adapted to fit over the upper edge of a fascia board or a rail associated with said board so as to provide a continuous support along the complete gutter length.

Adjacent gutter lengths may be connected together with expansion joints, e.g. via suitably shaped rubber sealing strips known per se.

Alternatively, since the support is continuous along each gutter length, adjacent lengths may be welded or otherwise directly fixed together, any changes in length dimensions due to temperature changes being accommodated by local buckling of the gutter lengths.

Preferably, the system includes fascia boards adapted to facilitate fitting of said gutter lengths. This may-be achieved by the boards being rebated or otherwise formed so that when fixed in position on the eaves of a building they present a continuous free upper edge onto which the gutter lengths can be readily located via their respective inverted U-shaped clips.

Conveniently, such fascia boards may be formed as extruded lengths of plastics material having a shape in cross-section suitable to provide said continuous free upper edges.

It will be appreciated that when fitted over the upper edges of the fascia boards, the inverted U-shaped clips permit longitudinal sliding movement of the gutter lengths with respect to said boards. Therefore, it is necessary to provide fixed points along the guttering, e.g. at ends, corners and downpipe outlets. To effect this, conveniently, each gutter length is provided with an aperture in its extended side wall into which a resilient grommet is fitted, via which the gutter length may be fixed with a limited flexing movement to its fascia board via screws or other suitable fixing means.

Setting of the drainage angle of inclination for the completed guttering can be readily effected in a number of ways.

For example, the rear face of the fascia board can be formed with a longitudinal groove at the requisite angle with respect to its upper edge and the free longitudinal edge of the inverted U-shaped clip of each gutter length can be formed with a longitudinal bead or other suitable protrusion to locate in the groove, thereby setting the angle automatically when fitted.

Alternatively, the front face of the facia board can be provided with a longitudinal rib set at the requisite angle on .which the bottom walls of the gutter lengths can seat.

In another arrangement, a longitudinal rib can be provided in the face of the fascia board which is parallel to the upper edge of said board and setting devices can be mounted at spaced positions along the rib, each having a stop face which is adjustable in height to set the alignment and inclination of the gutter lengths.

In order that the invention may be readily understood and further features made apparent, one embodiment of gutter length and alternative adjustment arrangements therefor will now be described with reference to the accompanying drawings in which:

FIG. 2A is a view of said setting device in the direction of Arrow B in FIG. 2, and FIGS. 3 to 5 are similar, fragmentary views showing different alternative forms of setting devices.

Figures 1, 1A:
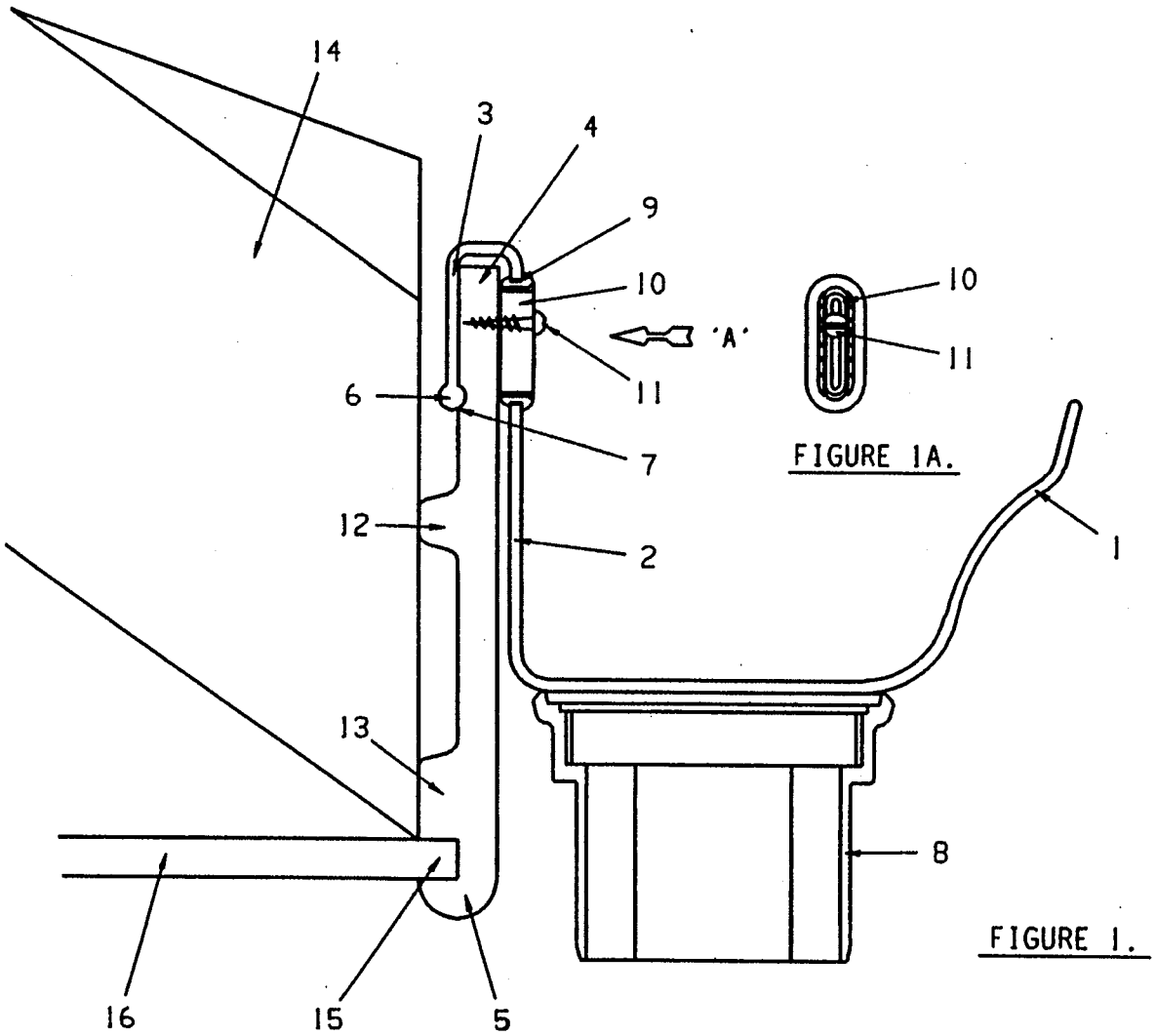
FIG. 1 is a part-sectioned view of a gutter length fitted to a fascia board.
FIG. 1A is a detail of the part shown in the direction of Arrow "A" in FIG. 1

Referring to FIG. 1, the guttering system is of a suitable plastics material such as PVC and comprises extruded gutter lengths 1 which are trough shaped in cross-section as shown. The rearward side wall 2 of each gutter length is extended upwardly and then reversed back on itself as shown to define an inverted U-shaped clip 3. The clip 3 is dimensioned to be a sliding fit onto the upper edge 4 of an associated fascia board 5 so that each gutter length 2 is supported continuously therealong. As shown the downturned free edge of the clip 3 is formed with a bead 6 and, conveniently, this bead is located within and along a longitudinal groove 7 formed in the rear face of the fascia board, which groove extends parallel to the upper edge 4 of said board. The gutter lengths are thereby positively located vertically.

The gutter lengths 2 may be connected together end-to-end by expansion joints, known per se, so as to accommodate small changes in length of the guttering due to variations in ambient temperatures. Alternatively, since a continuous support is provided along the complete length of the guttering, the gutter lengths may be welded directly together e.g. by a suitable solvent adhesive, in which case changes in length are accommodated by local buckling.

It will be appreciated that although positively located vertically via the interfitting bead 6 and groove 7, the guttering can nevertheless slide longitudinaly along the groove. Because of this, it is necessary to fix the guttering at critical points, e.g. at the ends and corners of the guttering and also where an opening is provided for a downpipe 8. To effect this, each gutter length is provided with one or more apertures 9 in which a resilient grommet 10 is retained (see also FIG. 1A) and via which the rear side wall 2 of the gutter lengths can be locally fixed with a limited flexing movement to the fascia board 5 via screws 11.

To facilitate fitting of the guttering, the fascia board 5 is preferably designed to present an upper edge 4 which is free and continuous over its complete length when fixed in position. As shown, this can be achieved by the fascia board being shaped to provide projecting upper and lower feet 12, 13 which act to space said upper edge 4 from the rafter ends 14 of the building eaves. Conveniently, the rear face of the lower foot 13 has a recess 15 for accommodating the outer longitudinal edge of a soffit board 16. Preferbaly, the fascia boards are extruded lengths of a suitable plastics material, e.g. as sold under the. Registered Trade Mark "CELUFORM".

In order to set the drainage inclination for the guttering, the groove 7 in the fascia board may be formed at the required angle of inclination with respect to the upper edge 4.

Figure 2:
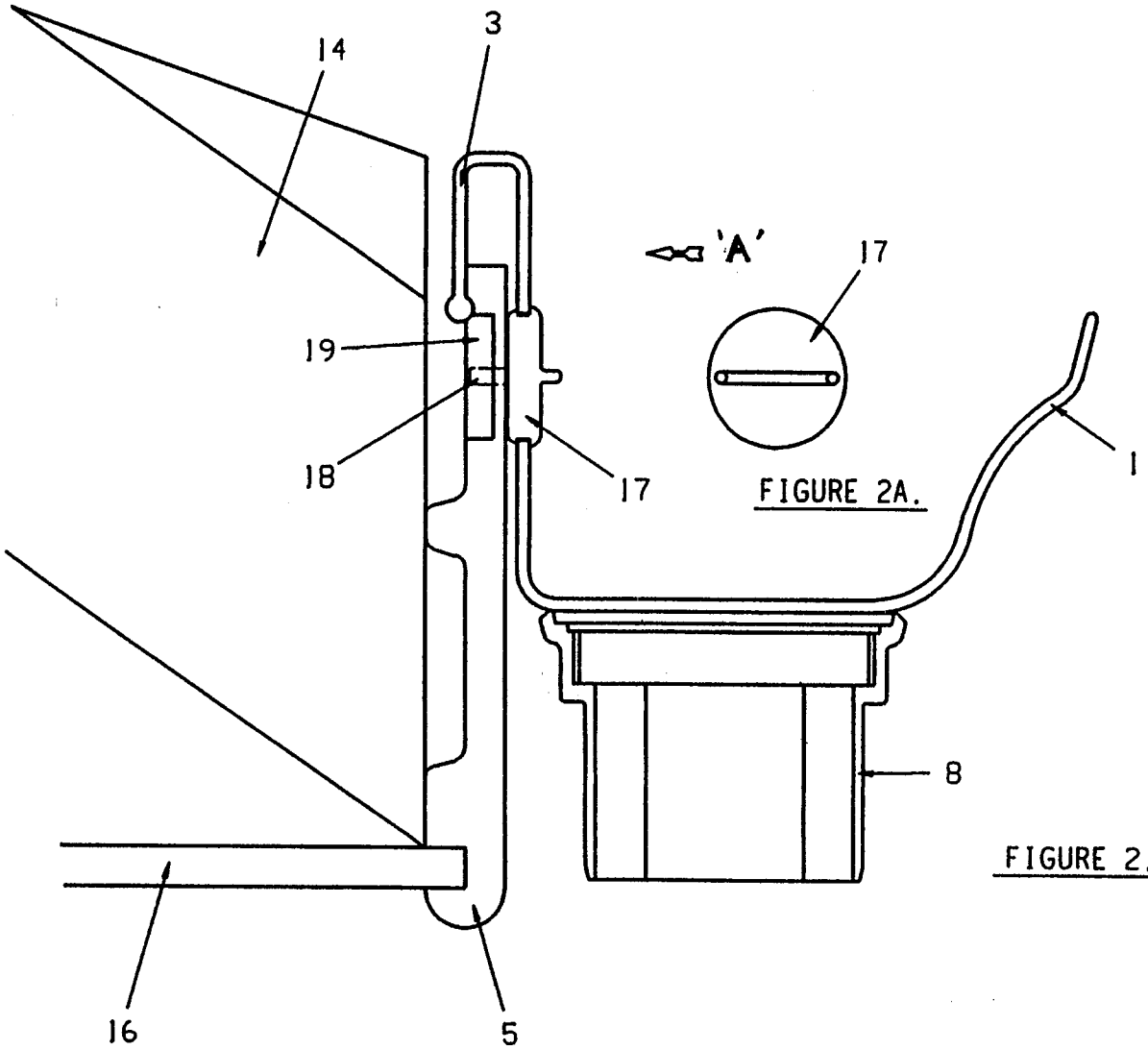
FIG. 2 is a view similar to FIG. 1, showing one form of setting device

Alternatively, selected apertures 9 in the gutter lengths, or additional apertures if needed, may retain rotatable plugs 17 as shown in FIGS. 2 and 2A having cam means 18, e.g. an offset rearward facing pin, which co-operates with receiving means 19 (e.g. a slot), provided in the fascia board 5 so that the vertical height at that fixing point can be adjusted by rotation of said plug.

Figures 3, 4, 5:
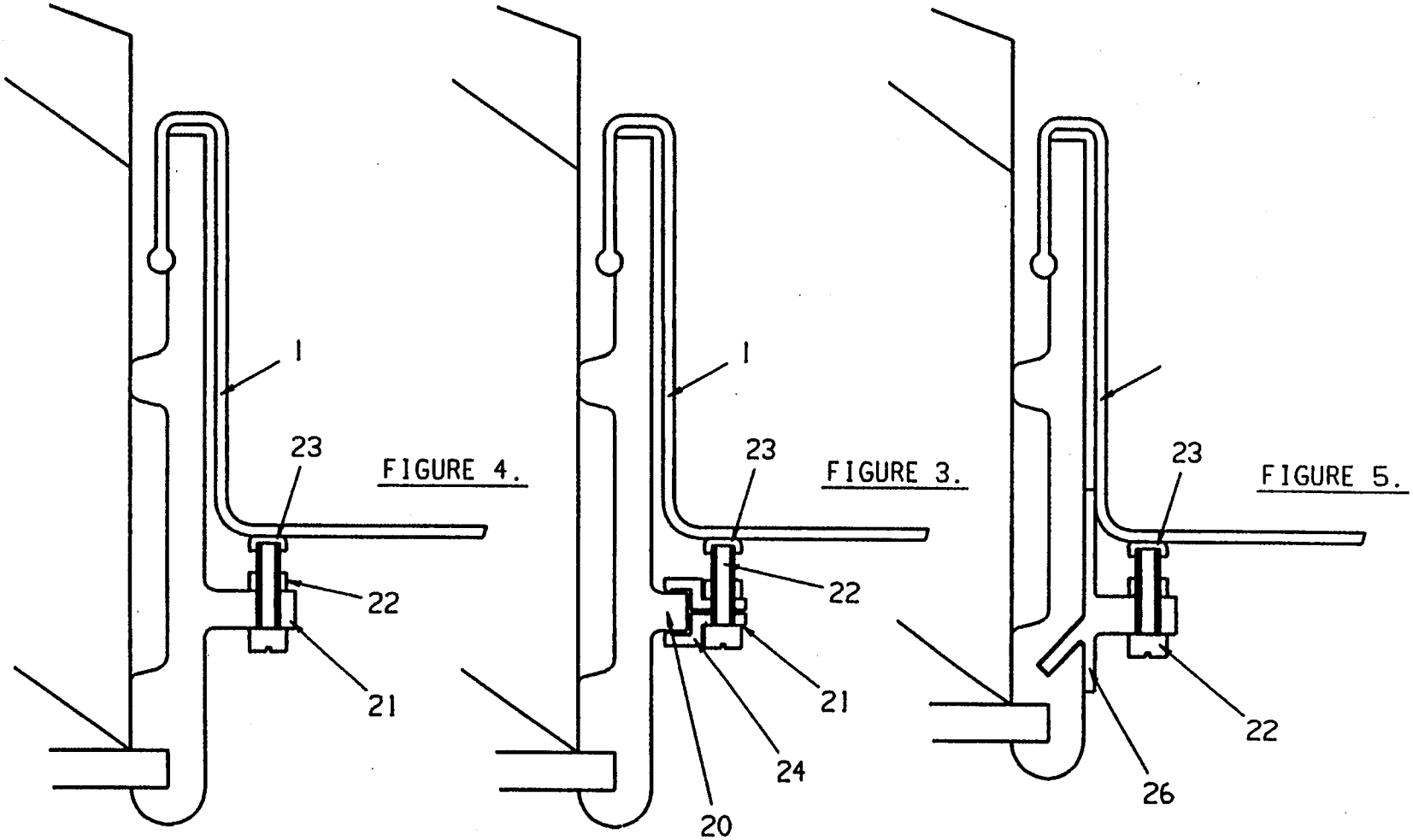

Alternatively, as shown in FIGS. 3 and 4, the front face of the fascia board 5 can be provided with a projecting rib 20 along which setting devices 21 can be spaced, each device having a vertically directed screw 22 to provide an adjustable stop end 23. In FIG. 3, each device 21 has lugs 24 for mounting on the rib 20. In FIG. 4, the rib itself provides a screwed aperture for the screw 22.

With reference to FIG. 5, instead of a rib 20, the front face of the fascia board provides an angled groove for receiving a similarly angled support lug 26 of the setting devices 21.

I claim:

1. A plastics rainwater guttering system comprising a plurality of gutter lengths having a generally trough-like cross-sectional shape, each of said plurality of gutter lengths having one side wall extending upwardly and that one side wall reversing back on itself to form an inverted U-shaped clip for engaging an upper edge of one of a fascia board and a rail associated with a fascia board once the fascia board is secured to a desired building;

wherein said one side wall has at least one aperture provided therein for accommodating-one of a grommet and plug by which each of the gutter lengths can be securely fastened, by fastening member, at selected spaced intervals to the fascia board, adjacent gutter lengths are directly connectable end to end with one another, and the connection of the gutter lengths to the fascia board being such that any variation in a length dimension of the gutter lengths, due to temperature changes, are accommodated by local buckling of the gutter lengths.

2. A guttering system according to claim 1, wherein said system further includes at least one fascia board for supporting the gutter lengths, the fascia board provides a continuous support surface for the entire gutter lengths and are shaped such that when the fascia board is fixed in position to an eave of a building, the fascia board provides a continuous free upper edge onto which the gutter lengths can be readily secured via the respective inverted U-shaped clips; and the fascia board is formed as extruded lengths of a plastics material having a suitable cross-sectional shape so as to provide the continuous free upper edge facilitating end to end connection of the gutter lengths.

3. A plastics rainwater guttering system comprising a plurality of gutter lengths having a generally trough-like cross-sectional shape, each of the plurality of gutter lengths having one side wall extending upwardly and that side wall reversing back on itself to form an inverted U-shaped clip for engaging an upper edge of one of a fascia board and a rail associated with a fascia board once the fascia board is secured to a desired building; and a fascia board for supporting the plurality of gutter lengths, the fascia board being shaped such that when the fascia board is secured to an save of a building, the fascia board provides a continuous free upper edge onto which the plurality of gutter lengths can be readily secured via their respective inverted U-shaped clips;

wherein the one side wall has at least one aperture therein for accommodating one of a grommet and plug by which each of the gutter lengths is securely fastenable, by a fastening member, to the fascia board at the selected spaced intervals, adjacent gutter lengths are directly connectable end to end with one another and the connection of the gutter lengths to the fascia board being such that any variation in a length dimension of the gutter lengths, due to temperature changes, are accommodated by local buckling of the gutter lengths.

4. A guttering system according to claim 3, wherein said at least one aperture accommodates a rotatable plug having a cam member cooperating with a receiving member of the fascia board, and rotation of the plug provides vertical adjustment to facilitate setting of the drainage angle of the system.

5. A guttering system according to claim 3, wherein a rear face of the fascia board has a longitudinal groove provided therein and positioned to receive one of a bead and a projection extending longitudinally along a free end of the inverted U-shaped clip, and the engagement between the longitudinal groove and one of the bead and the projection provides a positive vertical location for the gutter lengths.

6. A guttering system according to claim 5, wherein the groove extends at a requisite angle of inclination for drainage along the fascia board to set automatically the angle of the gutter lengths supported thereon.

7. A guttering system according to claim 3, wherein a longitudinal rib is provided along a front face of the fascia board, the longitudinal rib extends parallel to the upper edge of the fascia board and setting devices are mounted at spaced locations along the longitudinal rib, and each setting device has a stop which is adjustable in height to set alignment and inclination of the gutter lengths.

8. A guttering system according to claim 3, wherein each said fascia board is formed as an extruded length of a plastics material having a suitable cross-sectional shape so as to provide the continuous free upper edge facilitating end to end connection of the gutter lengths.

9. A guttering system according to claim 3, wherein said system includes means for adjusting the drainage angle of the gutter.

* * * * *